US012644401B2

(12) United States Patent
Valdomiro De Azevedo et al.

(10) Patent No.: US 12,644,401 B2
(45) Date of Patent: Jun. 2, 2026

(54) SUMP AND HEAT EXCHANGER MODULE

(71) Applicant: MAHLE International GmbH, Stuttgart (DE)

(72) Inventors: Edson Valdomiro De Azevedo, Shelby Township, MI (US); Fernando Yoshino, Oakland Township, MI (US); Brian Heckman, Linden, MI (US)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 19/038,245

(22) Filed: Jan. 27, 2025

(65) Prior Publication Data

US 2026/0022650 A1 Jan. 22, 2026

Related U.S. Application Data

(60) Provisional application No. 63/672,555, filed on Jul. 17, 2024.

(51) Int. Cl.
*F01M 11/00* (2006.01)

(52) U.S. Cl.
CPC . *F01M 11/0004* (2013.01); *F01M 2011/0025* (2013.01)

(58) Field of Classification Search
CPC ..... F01M 11/0004; F01M 2011/0025
See application file for complete search history.

(56) References Cited

U.S. PATENT DOCUMENTS 1,290,638 A * 1/1919 Morgan ..... F01M 5/002 165/41
2,782,008 A * 2/1957 Caughill ..... F28F 3/12 165/47
2,844,129 A * 7/1958 Beck, Jr. ..... F01P 3/04 123/41.21
4,150,655 A * 4/1979 Gaggiano ..... F01P 11/08 123/196 AB
5,408,965 A * 4/1995 Fulton ..... F01M 11/0004 123/196 AB (Continued)

FOREIGN PATENT DOCUMENTS

CN 206071670 U 4/2017
CN 207701193 U 8/2018

(Continued)

OTHER PUBLICATIONS

EESR, EP25189677.5, dated Dec. 9, 2025.

*Primary Examiner* — Henry Y Liu
(74) *Attorney, Agent, or Firm* — Fishman Stewart PLLC

(57) ABSTRACT

A sump and heat exchanger module may include a housing shell and a cover. The housing shell may at least partially define an internal space. The housing shell may include a sump section configured to receive at least a portion of a sump and a heat exchanger section configured to receive at least a portion of a heat exchanger. The cover may be disposed in the housing shell and may divide the internal space into a heat exchanger space and a sump space. The housing shell may further include a recess via which the heat exchanger space opens into the sump space. The cover may be connected to the housing shell and close the recess sealing the heat exchanger space and the sump space from one another.

20 Claims, 10 Drawing Sheets

(56) References Cited

U.S. PATENT DOCUMENTS

| | | | | |
|---|---|---|---|---|
| 6,217,758 | B1 * | 4/2001 | Lee | F01M 11/0004 210/186 |
| 6,488,003 | B2 * | 12/2002 | Karlsson | F01M 11/0004 123/196 AB |
| 6,817,335 | B2 * | 11/2004 | Groddeck | F02B 75/22 123/195 A |
| 7,343,907 | B2 * | 3/2008 | Raab | F01M 11/0004 123/196 R |
| 9,016,245 | B2 * | 4/2015 | Van Farowe | F01P 11/08 165/145 |
| 9,228,484 | B2 * | 1/2016 | Van Farowe | F01M 11/03 |
| 9,457,881 | B1 * | 10/2016 | Belter | B63H 20/001 |
| 9,664,077 | B2 * | 5/2017 | Zahdeh | F01M 5/001 |
| 9,777,824 | B2 * | 10/2017 | Patil | F16H 57/031 |
| 11,548,604 | B1 * | 1/2023 | Misorski | B63H 21/38 |
| 2004/0177827 | A1 * | 9/2004 | Hoyte | F01M 11/0004 123/196 AB |
| 2008/0257625 | A1 | 10/2008 | Stranges | |
| 2010/0037850 | A1 * | 2/2010 | Jessberger | F01M 11/0004 251/129.01 |
| 2010/0319638 | A1 | 12/2010 | Hollweck | |
| 2016/0222844 | A1 * | 8/2016 | Zahdeh | F01M 11/0004 |
| 2016/0222845 | A1 * | 8/2016 | Zahdeh | F01M 5/001 |
| 2016/0237867 | A1 * | 8/2016 | Zahdeh | F01M 11/0004 |
| 2017/0051821 | A1 * | 2/2017 | Long | F16H 57/0452 |
| 2017/0114683 | A1 * | 4/2017 | Schlee | F01M 13/04 |
| 2018/0252128 | A1 * | 9/2018 | Rossignol | B29C 66/543 |
| 2020/0309472 | A1 * | 10/2020 | Thomas | F28F 9/0246 |
| 2023/0287812 | A1 * | 9/2023 | Peters | F16H 57/045 |
| 2024/0159188 | A1 * | 5/2024 | Durocher | F02C 7/185 |
| 2024/0247600 | A1 * | 7/2024 | Kostic | F01M 1/12 |
| 2024/0247601 | A1 * | 7/2024 | Kostic | F01M 11/0004 |

FOREIGN PATENT DOCUMENTS

| | | | |
|---|---|---|---|
| CN | 209308778 | U | 8/2019 |
| CN | 214247451 | U | 9/2021 |
| CN | 218294399 | U | 1/2023 |
| CN | 219299387 | U | 7/2023 |
| CN | 219796056 | U | 10/2023 |
| DE | 102012216918 | A1 | 3/2014 |
| EP | 3165728 | A1 | 5/2017 |
| GB | 1043113 | A | 9/1966 |
| KR | 102370051 | B1 | 3/2022 |
| KR | 20240058462 | A | 5/2024 |

* cited by examiner

SUMP AND HEAT EXCHANGER MODULE

CROSS-REFERENCE TO RELATED APPLICATIONS

This application claims priority to United States Provisional Patent Application No. U.S. 63/672,555, filed on Jul. 17, 2024, the contents of which is hereby incorporated by reference in its entirety.

TECHNICAL FIELD

The present disclosure generally relates to sumps (e.g., oil sumps), heat exchangers (e.g., oil coolers), and sump and heat exchanger modules, assemblies, and/or systems (e.g., oil sump and oil cooler modules) that may, for example, be used in connection with motor vehicles.

BACKGROUND

A heat exchanger (e.g., an oil cooler) may be mounted on a sump (e.g., an oil sump) or a plastic component to form a module, assembly, and/or system, such as an oil sump and oil cooler module (OSOC module). Connecting and/or mounting the heat exchanger on the sump (e.g., a housing of the sump) generally requires many external fixation features and/or components and, thus, conventional OSOC modules can be time consuming, complex, costly, and/or inefficient to produce and/or assemble. Additionally, since the heat exchanger is typically disposed outside of the housing of the sump in conventional OSOC modules, the heat exchanger is exposed and/or subjected to adverse environmental conditions. This can, for example, lead to corrosion of one or more components (e.g., aluminum components) of the heat exchanger. Traditional and/or standard heat exchangers, which typically include a first subset of plates that conduct oil and a second subset of plates that conduct coolant, that are often utilized in conventional OSOC modules also experience a high coolant pressure drop during operation, which negatively impacts performance and/or efficiency. These traditional and/or standard heat exchangers are also susceptible to clogging and could, for example, get clogged due contamination on the coolant/water mixture.

Accordingly, there is a need for an improved oil sump and oil cooler module (OSOC module) that minimizes or eliminates one or more challenges or shortcomings of existing OSOC modules.

SUMMARY

A sump and heat exchanger module may include a housing shell and a cover. The housing shell may at least partially define an internal space. The housing shell may include a sump section configured to receive at least a portion of a sump and a heat exchanger section configured to receive at least a portion of a heat exchanger. The cover may be disposed in the housing shell and may divide the internal space into a heat exchanger space and a sump space. The housing shell may further include a recess via which the heat exchanger space opens into the sump space. The cover may be connected to the housing shell and close the recess sealing the heat exchanger space and the sump space from one another.

A sump and heat exchanger module may include a housing shell, a cover, a sump, and a heat exchanger. The housing shell may include (i) a sump section at least partially defining a sump space and (ii) a heat exchanger section at least partially defining a heat exchanger space. The cover may be disposed in the housing shell and may fluidically seal the heat exchanger space and the sump space from one another. The sump may be disposed at least partially in the sump space of the housing shell. The heat exchanger may be disposed at least partially in the heat exchanger space of the housing shell.

Various other features and advantages will be made apparent from the following detailed description and the drawings.

BRIEF DESCRIPTION OF THE DRAWINGS

While the claims are not limited to a specific illustration, an appreciation of various aspects may be gained through a discussion of various examples. The drawings are not necessarily to scale, and certain features may be exaggerated or hidden to better illustrate and explain an innovative aspect of an example. Further, the exemplary illustrations described herein are not exhaustive or otherwise limiting, and embodiments are not restricted to the precise form and configuration shown in the drawings or disclosed in the following detailed description. Exemplary illustrations are described in detail by referring to the drawings as follows:

DETAILED DESCRIPTION

Figure 1:
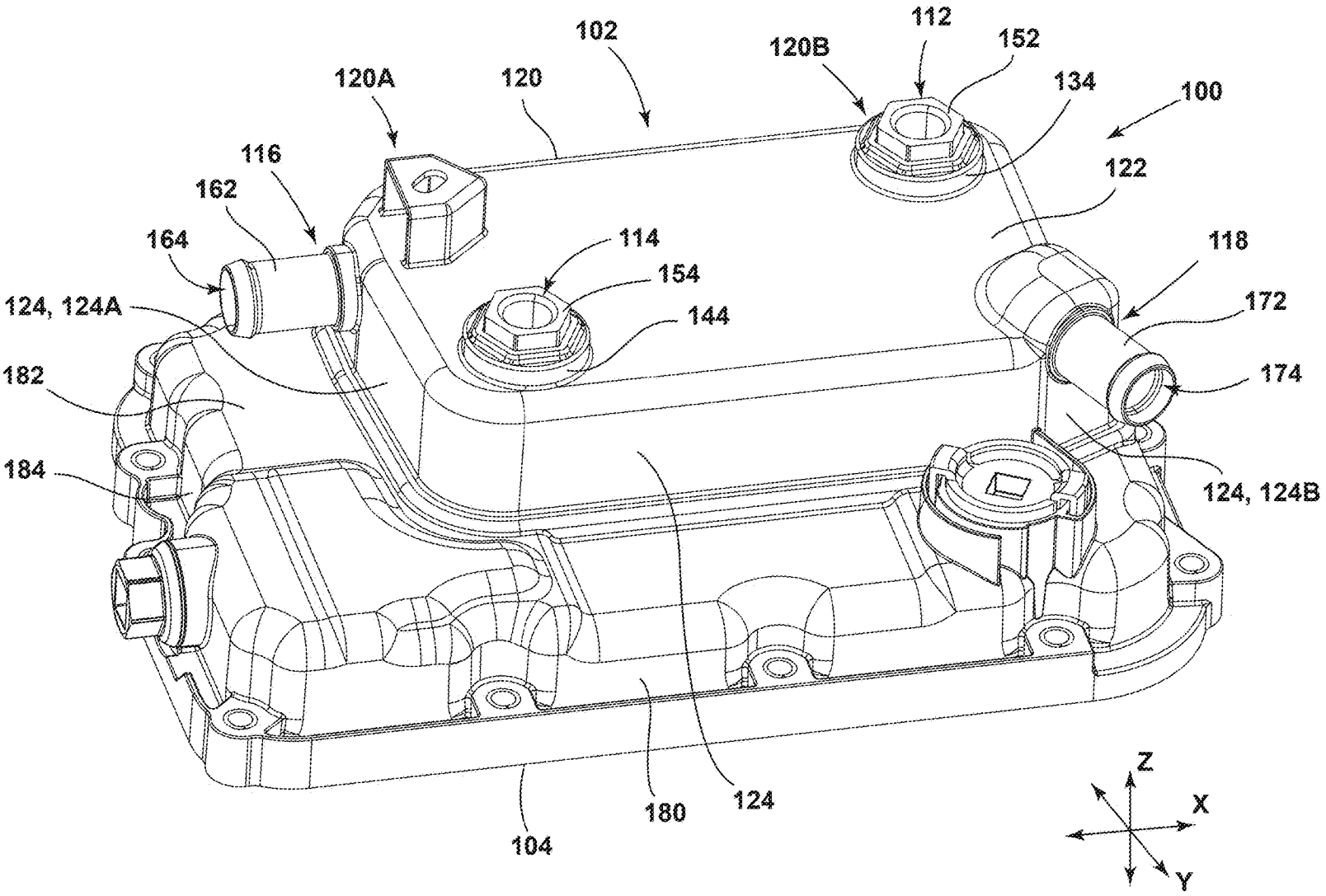
FIGS. 1 and 2 are perspective views of an exemplary sump and heat exchanger module.
Figure 2:
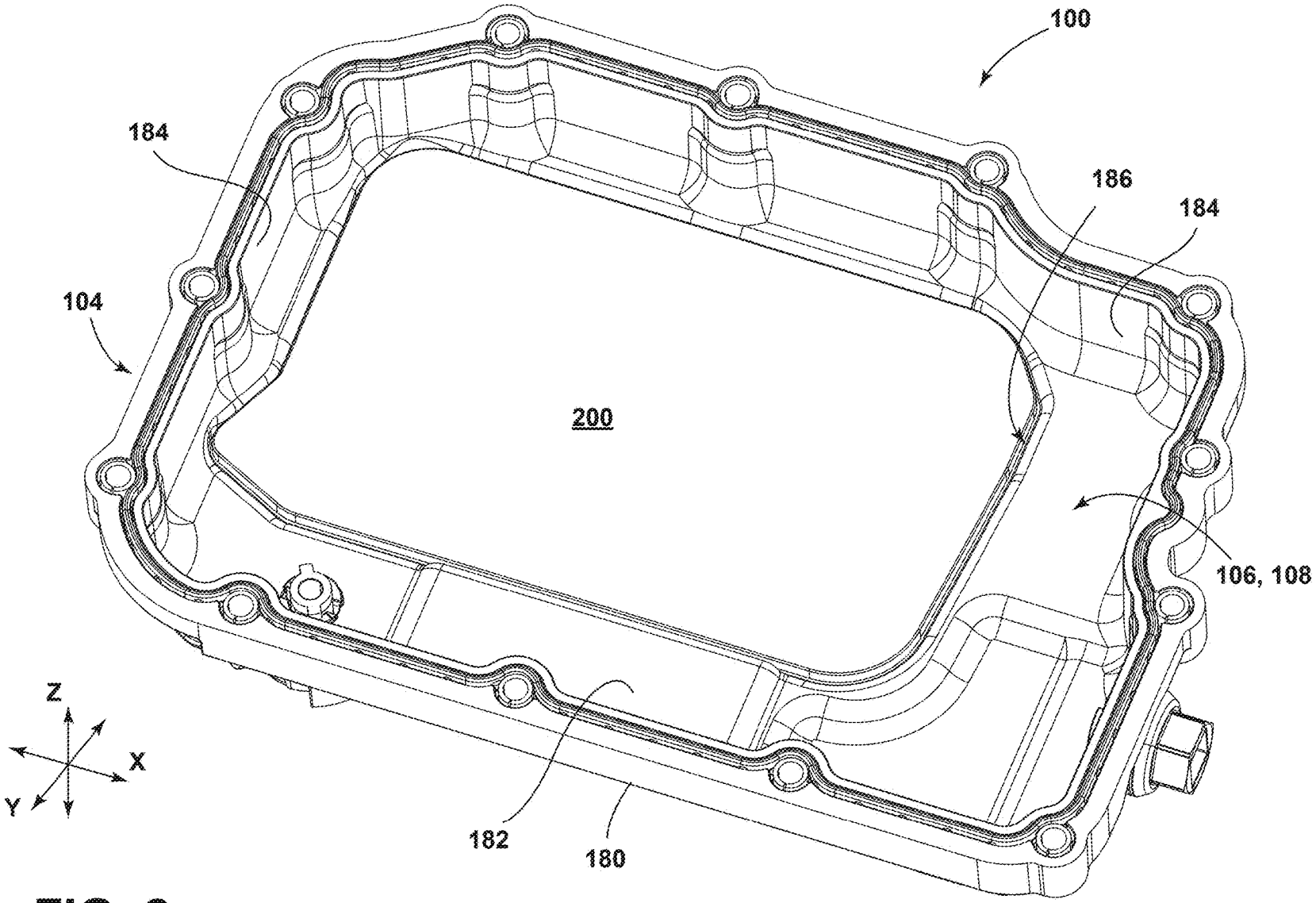

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Disclosed is a sump and heat exchanger module 100 for a motor vehicle (e.g., an automobile), at least some examples of which may also be considered and/or referred to as a sump with an embedded heat exchanger, an oil sump and oil cooler module (OSOC module), and/or an oil sump with an embedded oil cooler. As generally illustrated in the exploded cross-sectional view of FIG. 4, the module 100 includes a plastic housing 102, a cover 200, a sump 600 (e.g., an oil sump), a heat exchanger 700 (e.g., an oil cooler), and optionally at least one structure 300. The housing 102 includes at least one housing shell 104, which is composed of a corrosion resistant plastic. The housing shell 104 is connected and/or connectable to the structure 300, which optionally closes an open end of the housing shell 104. In some examples, such as those in which the structure 300 is configured as a second housing shell 300', the structure 300, 300' is a part and/or portion of the module 100 and/or the housing 102. In other examples, such as when the structure 300 is a body of another component, device, and/or apparatus, the structure 300 is not a part and/or portion of the module 100 and the module 100 may be mounted on and supported by the structure 300 by connecting the housing shell 104 to the structure 300. The housing 102 and/or the housing shell 104 at least partially receives, encloses, and/or protects one or more portions and/or components of both the sump 600 and the heat exchanger 700. The cover 200 is disposed inside the housing 102 and/or the housing shell 104, and partitions/divides an internal space 106 of the housing 102 and/or housing shell 104 into a sump space 108 and a heat exchanger space (HE space) 110. The sump 600 and/or one or more components thereof is at least partially disposed in the sump space 108. The heat exchanger 700 and/or one or more components thereof is at least partially disposed in the HE space 110. A first fluid may be disposed within and/or flow through the sump space 108 and/or the sump 600. A second fluid and a coolant may be disposed within and/or flow through the HE section 120, the HE space 110, and/or the heat exchanger 700 (e.g., the HE core 702). The first fluid, the second fluid, and the coolant are fluidically separated from one another and may flow through the module 100 simultaneously.

Various depictions of an exemplary module 100 in which the cover 200 is connected to the housing shell 104 via a weld and/or a welded connection are depicted in FIGS. 1-7. Another exemplary module 100 in which the cover 200 is releasably and/or removably connected to the housing shell 104 via a mechanical connection 212, such as by mechanical fasteners 214 (e.g., screws), is illustrated in FIGS. 8A-8C.

While the module 100 includes a single sump 600, a single heat exchanger 700, a single HE core 702, two fluid ports 112, 114, and two coolant ports 116, 118 in the illustrative examples herein, the module 100 may conceivably include several sumps 600 arranged in a single sump section 180 or in separate sump sections 180, several heat exchangers 700 and/or HE cores 702 arranged in a single HE section 120 or in separate HE sections 120, more than two fluid ports 112, 114 (e.g., a pair of fluid ports 112, 114 for each heat exchanger 700 and/or HE core 702), and/or more than two coolant ports 116, 118 (e.g., a pair of coolant ports 116, 118 for each heat exchanger 700 and/or HE core 702). Additionally and/or alternatively, one or more inventive concepts of the module 100 (e.g., providing a component and/or housing with an encapsulating and hermetically sealed chamber for receiving a heat exchanger) may be extrapolated to many other applications (e.g., applications and/or environments in which a heat exchanger is arranged adjacent to a component and/or housing other than a sump).

The arrangement of one or more portions, components, and/or elements of the heat exchanger 700 (e.g., the HE core 702 and/or plates 704, which may be composed at least partially of aluminum and/or susceptible to corrosion) within the housing 102 protects those portions, components, and/or elements of the heat exchanger 700 from the surrounding environment (e.g., adverse environmental conditions) unlike conventional OSOC modules. This protects the heat exchanger 700 and/or portions thereof (e.g., the HE core 702 and/or plates 704) from corrosion, extends the service life of the module 100 and/or the heat exchanger 700, and reduces the maintenance costs of the module 100 and/or the heat exchanger 700 relative to conventional OSOC modules.

Moreover, as the housing 102 and/or the housing shell 104 is composed of a plastic resistant to corrosion, it is not necessary to apply a special alloy to the heat exchanger 700 and/or portions thereof to provide corrosion protection and/or resistance. Production and assembly of the module 100 is thus simplified and less costly compared to conventional OSOC modules. The corrosion-resistant plastic of the housing 102 and/or housing shell 104 also resists corrosion better than metal (e.g., aluminum) and improves the durability of the module 100.

The module 100 also eliminates the need for the heat exchanger 700 to have fixation features and an aluminum base plate, which are common in conventional OSOC modules. The plastic housing 102 and/or housing shell 104 includes the coolant ports and/or connection features (e.g., coolant connectors 162, 172) for the coolant system of the heat exchanger 700 thereby additionally eliminating the need for separate and/or aluminum ports and/or connection features that are common in conventional OSOC modules. This, among other things, allows the disclosed module 100 to achieve a significant reduction in (i) overall weight and (ii) weight of aluminum components compared to conventional OSOC modules.

The module 100 utilizes a submarine-style heat exchanger 700, which includes a heat exchanger core (HE core) 702 and/or plates 704 that only conduct oil (i.e., does not include a subset of plates that conduct coolant like conventional style heat exchangers and/or oil coolers). As such, there is no embedded coolant flow through the HE core 702. Rather, coolant is conducted through a portion/region/space of the housing 102 in which the HE core 702 is arranged (i.e., the HE space 110) and the coolant flows around an exterior of the HE core 702 (e.g., one or more plates 704 thereof). The module 100 experiences a reduced coolant pressure drop, has an improved coolant flow, and is less susceptible to clogging compared to conventional OSOC modules due at least in part to utilizing a submarine-style heat exchanger 700 as opposed to a traditional and/or standard style heat exchanger like conventional OSOC modules. The HE core 702 of the submarine-style heat exchanger 700 is modular and may be utilized in conjunction with a variety of different ports, adapters, and/or connectors. As such, an aluminum tube for a coolant line, which is utilized in many conventional OSOC modules, is not necessary in the disclosed module 100. In at least some examples of the disclosed module 100, there is only one thickness size for the HE core 702 and/or the plates 704 of the heat exchanger 700.

Utilizing the submarine-style heat exchanger 700 also reduces the weight of the heat exchanger 700 and/or the module 100. For example, a module 100 with an integral connection 202 between the housing shell 104 and the cover 200 and a submarine-style heat exchanger 700 like in FIGS. 1-7 has a total weight (e.g., approx. 1.297 kg) that is around 25% less than when a conventional heat exchanger with an internal through-flow of coolant is utilized. The submarine-style heat exchanger 700 in this example may also have a total weight (e.g., approx. 0.462 kg) that is around 59% less than the comparable conventional heat exchanger with an internal through-flow of coolant. As another example, a module 100 with releasable mechanical connections 212 between the housing shell 104 and the cover 200 and a submarine-style heat exchanger 700 like in FIGS. 8A-8C has a total weight (e.g., approx. 1.598 kg) that is around 8% less than when a conventional heat exchanger with an internal through-flow of coolant is utilized. The submarine-style heat exchanger 700 and seal 216 in this example have a total weight (e.g., approx. 0.553 kg) that is around 51% less than the comparable conventional heat exchanger with an internal through-flow of coolant.

As generally illustrated in FIGS. 3-7, the housing 102 and/or the housing shell 104 includes and/or defines an internal space 106, which includes a sump space 108 and a heat exchanger space (HE space) 110. The housing 102 and/or the housing shell 104 may form and/or be considered a component of the sump 600 and/or the heat exchanger 700. The housing 102 and/or the housing shell 104 at least partially receives, encloses, and/or protects one or more portions and/or components of both the sump 600 and the heat exchanger 700.

The housing shell 104 includes a first/heat exchanger section, region, and/or portion, which may be referred to as the HE section 120, and a second/sump section, region, and/or portion 180, which may be referred to as the sump section 180. The sump section 180 is configured to receive at least a portion of the sump 600, at least partially defines and/or delimits the sump space 108, and is connected and/or connectable to the structure 300. The HE section 120 is disposed on and projects from the sump section 180, is configured to receive at least a portion of the heat exchanger 700, and at least partially defines and/or delimits the HE space 110.

As generally illustrated in FIGS. 1, 2, and 4-6, the sump section 180 includes a plurality of walls, including a base wall 182 and one or more sidewalls 184. The sidewalls 184 are connected to and extend from the base wall 182. The sidewalls 184 project transversely (e.g., obliquely or perpendicularly) from the base wall 182 and extend around an outer perimeter of the base wall 182. The housing shell 104, sump section 180, and/or base wall 182 includes a recess 186, which is disposed in and defined by the base wall 182. The recess 186 extends completely through the base wall 182 such that the HE space 110 opens into the sump space 108 via the recess 216.

The sump section 108 is (e.g., releasably or non-releasably) connected and/or connectable to the structure 300 (e.g., a separate second housing shell 300' and/or a portion or body of another device, apparatus, and/or assembly), such as to form the housing 102, close the sump space 108, and/or mount the module 100. A free end of the side walls 184 and/or an end of the sump section 180 opposite the HE section 120 is connected and/or connectable to the structure 300, 300'. Optionally, the structure 300, 300' closes and/or seals an open end of the housing shell 104, the sump section 180, and/or the sump space 108 (e.g., disposed opposite the base wall 182). In some examples, the module 100 is mounted on and supported by the structure 300, 300' via the connection of the sump section 180 to the structure 300, 300'.

The sump section 180 also optionally includes a first fluid inlet port and/or a first fluid outlet port via which the module 100, sump section 180, sump space 108, and/or sump 600 receive and/or output the first fluid. The first fluid inlet port may be connectable (e.g., physically and/or fluidically) to one or more other components that supply and/or convey the first fluid to the module 100 and/or the sump 600. The first fluid outlet port may be connectable (e.g., physically and/or fluidically) to one or more other components that receive the first fluid from the module 100 and/or the sump 600. Alternatively, in some examples, the structure 300, 300' connected to the sump section 180 includes the first fluid inlet port and/or the first fluid outlet port.

As generally illustrated in FIGS. 1 and 3-7, the HE section 120 includes a plurality of walls, including a base wall 122 and one or more sidewalls 124. The base wall 122 is disposed opposite the recess 186 of the sump section 180. The sidewalls 124 extend between and connect the base wall 122 of the HE section 120 and the base wall 182 of the sump section 180. The sidewalls 124 project transversely (e.g., obliquely or perpendicularly) from the base wall 122 of the HE section 120 and/or the base wall 182 of the sump section 180. The sidewalls 124 also extend around an outer perimeter of the base wall 122 of the HE section 120 and an outer perimeter of the recess 186 of the sump section 180.

Figure 5:
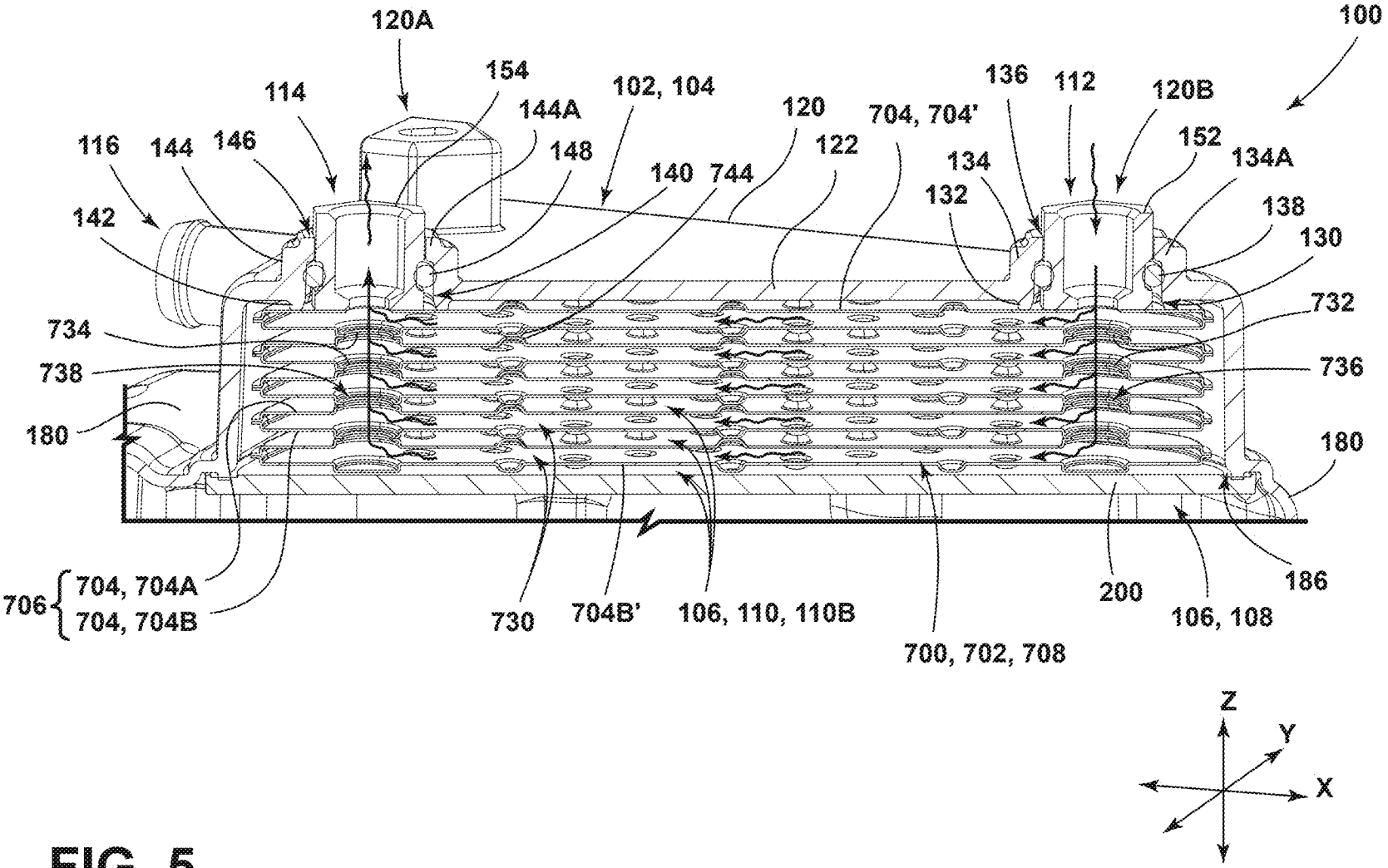
FIG. 5 is a cross-sectional perspective view of the module of FIG. 1 with the cross-section lying in a plane that is perpendicular to an X-Y plane and extends through the second fluid ports.

As generally illustrated in FIGS. 1 and 5, the housing 102, housing shell 104, HE section 120, and/or base wall 122 includes a plurality of fluid openings (e.g., a fluid inlet opening 130, a fluid outlet opening 140) via which the second fluid is flowable into and/or out of the HE section 120 and the HE core 702. The fluid openings 130, 140 are disposed in and defined by the base wall 122 of the HE section 120 of the housing shell 104. The fluid outlet opening 140 is disposed on a first side 120A of the HE section 120 and the fluid inlet opening 130 is disposed on an opposite second side 120B of the HE section 120.

As generally illustrated in FIG. 5, the housing 102, housing shell 104, HE section 120, and/or base wall 122 includes an internal inlet collar 132 and an internal outlet collar 142 that are annular in shape and project from the base wall 122 of the HE section 120 into the HE space 110. The internal inlet collar 132 extends around the perimeter of the fluid inlet opening 130. The internal inlet collar 132 sealingly contacts, abuts, and/or is connected to the HE core 702 (e.g., the uppermost plate 704A' thereof) such that the internal inlet collar 132 extends around the fluid inflow passage 736 and/or the first fluid opening 732 of the uppermost plate 704A'. In this way, the internal inlet collar 132 provides a seal between the HE section 120 of the housing shell 104 and the HE core 702, and effectively limits and/or prevents mixing of the second fluid and the coolant (e.g., via preventing and/or limiting the second fluid from leaking into the HE space 110 and/or the coolant from leaking into the fluid inflow passage 736).

Similarly, the internal outlet collar 142 extends around the perimeter of the fluid outlet opening 140. The internal outlet collar 142 sealingly contacts, abuts, and/or is connected to the HE core 702 (e.g., the uppermost plate 704A' thereof) such that the internal outlet collar 142 extends around the fluid outflow passage 738 and/or the second fluid opening 734 of the uppermost plate 704A'. In this way, the internal outlet collar 142 provides a seal between the HE section 120 of the housing shell 104 and the HE core 702, and effectively limits and/or prevents mixing of the second fluid and the coolant (e.g., via preventing and/or limiting the second fluid from leaking into the HE space 110 and/or the coolant from leaking into the fluid outflow passage 738).

As generally illustrated in FIGS. 1 and 5, the housing shell 104, the HE section 120, and/or the base wall 122 further includes an external inlet collar 134 and an external outlet collar 144 that are annular in shape and project from the base wall 122 of the HE section 120 in a direction away from the HE space 110. The external inlet collar 134 extends around the perimeter of the fluid inlet opening 130. A radially inward projecting lip 134A is arranged at a free end of the external inlet collar 134 disposed opposite the base wall 122. The lip 134A forms and/or defines an aperture 136 having a diameter that is smaller than the diameter of the fluid inlet opening 130 and/or the internal diameter of the external inlet collar 134. The lip 134A may be in and/or come into sealing contact with the fluid inlet seal 138 to limit and/or prevent fluid from leaking into and/or out of the HE space 110 and/or the fluid inflow passage 736.

Similarly, the external outlet collar 144 extends around the perimeter of the fluid outlet opening 140. A radially inward projecting lip 144A is arranged at a free end of the external outlet collar 144 disposed opposite the base wall 122. The lip 144A forms and/or defines an aperture 146 having a diameter that is smaller than the diameter of the fluid outlet opening 140 and/or the internal diameter of the external outlet collar 144. The lip 144A may be in and/or come into sealing contact with the fluid outlet seal 148 to limit and/or prevent the fluid from leaking into and/or out of the HE space 110 and/or the fluid outflow passage 738.

As generally illustrated in FIGS. 1 and 4-6, the module 100 and/or the housing shell 104 includes a fluid inlet adapter 152 via which the module 100, the heat exchanger 700, and/or the HE core 702 is connectable to one or more other components that supply and/or convey the second fluid (e.g., oil) to the module 100, the heat exchanger 700, and/or the HE core 702. The fluid inlet adapter 152 is configured to engage and/or connect to the fluid supplying component. The fluid inlet adapter 152 is disposed partially in the housing shell 104, the internal inlet collar 132, and/or the external inlet collar 134. The fluid inlet adapter 152 projects out of the HE section 120 of the housing shell 104 through the aperture 136 and is, therefore, also partially arranged outside of the housing shell 104. The fluid inlet seal 138 is disposed between and in sealing contact with the inner circumferential surface of the external inlet collar 134 and the outer circumferential surface of the fluid inlet adapter 152 thereby restricting and/or preventing fluid from leaking into and/or out of the HE section 120 and/or the housing 102 through the aperture 136. The fluid inlet adapter 152, the fluid inlet opening 130, the internal inlet collar 132, and/or the external inlet collar 134 collectively define a second fluid inlet port 112 of the module 100 via which the second fluid is flowable into the module 100, the HE section 120, and/or the heat exchanger 700.

The module 100 and/or the housing shell 104 includes a fluid outlet adapter 154 via which the module 100, the heat exchanger 700, and/or the HE core 702 is connectable to one or more other components that receive the second fluid (e.g., oil) from the module 100, the heat exchanger 700, and/or the HE core 702. The fluid outlet adapter 154 is configured to engage and/or connect to the fluid receiving component. The fluid outlet adapter 154 is disposed partially in the housing shell 104, the internal outlet collar 142, and/or the external outlet collar 144. The fluid outlet adapter 154 projects out of the housing shell 104 through the aperture 146 and is, therefore, also partially arranged outside of the housing shell 104. The fluid outlet seal 148 is disposed between and in scaling contact with the inner circumferential surface of the external outlet collar 144 and the outer circumferential surface of the fluid outlet adapter 154 thereby restricting and/or preventing fluid from leaking into and/or out of the HE section 120 and/or the housing 102 through the aperture 146. The fluid outlet adapter 154, the fluid outlet opening 140, the internal outlet collar 142, and/or the external outlet collar 144 collectively define a second fluid outlet port 114 of the module 100 via which the second fluid is flowable out from the module 100, the HE section 120, and/or the heat exchanger 700.

Figure 3:
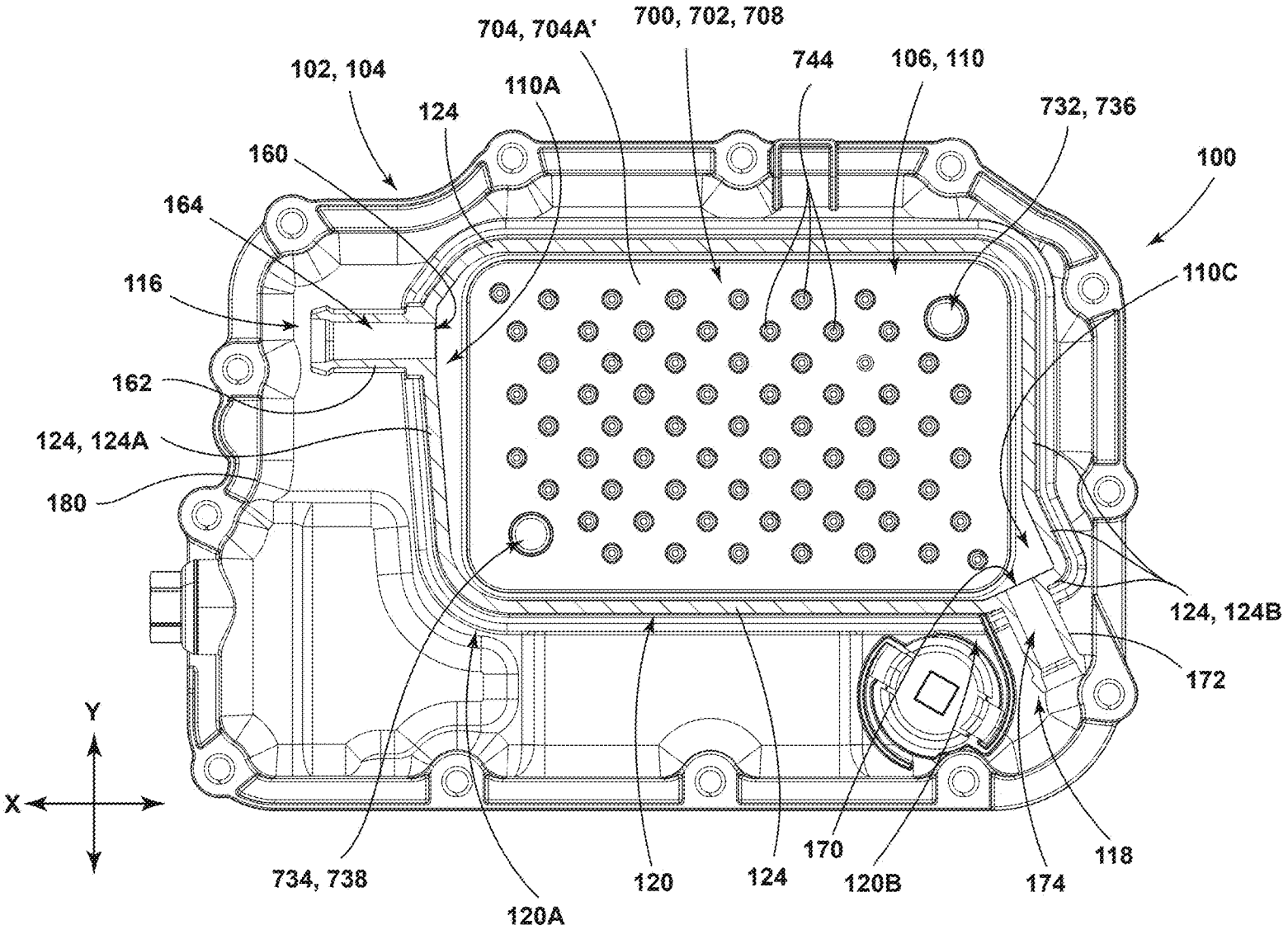
FIG. 3 is a top-down cross-sectional view of the module of FIG. 1 with the cross-section lying in an X-Y plane extending through the coolant ports.
Figure 4:
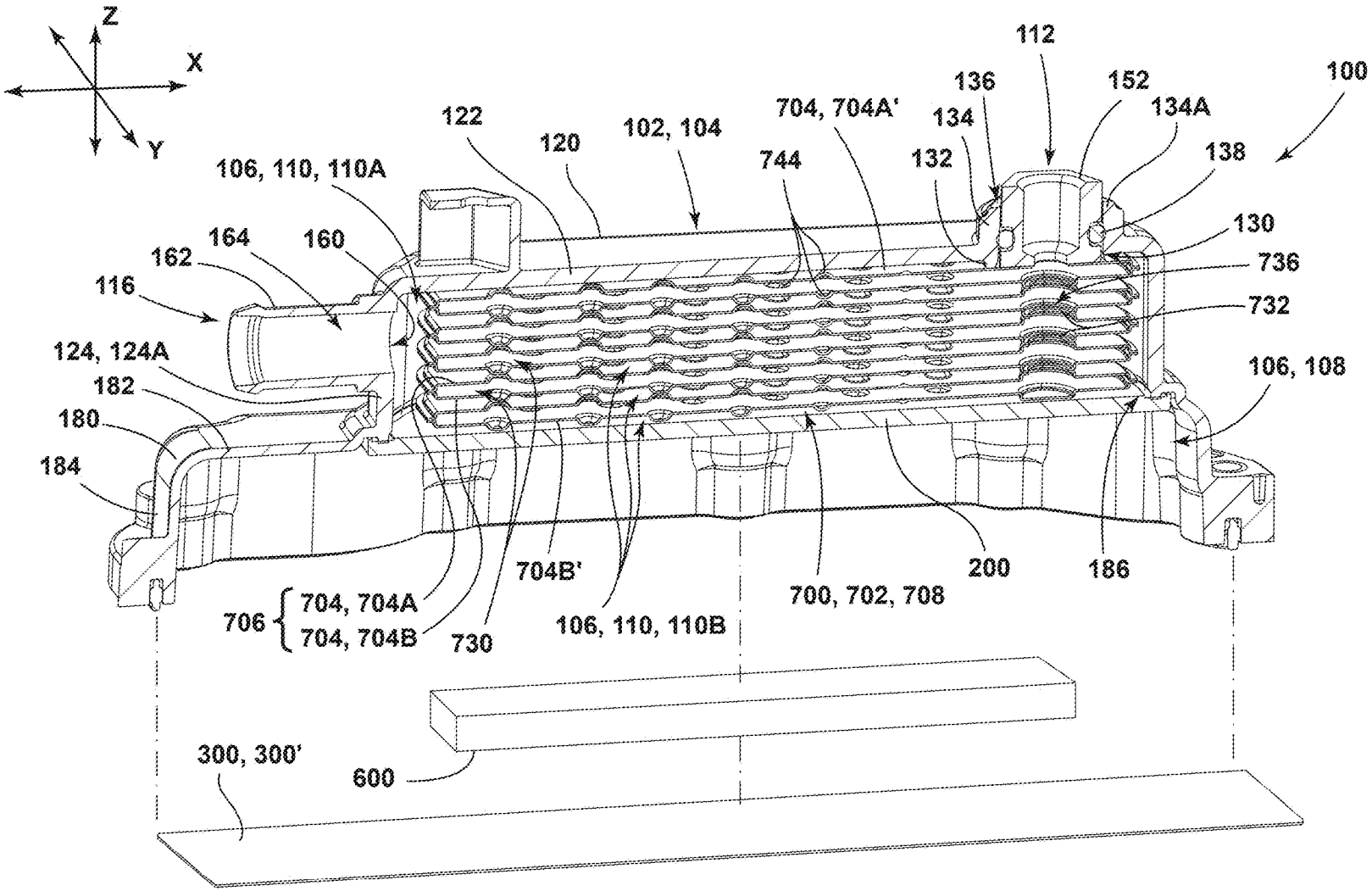
FIG. 4 is an exploded, perspective cross-sectional view of the module of FIG. 1 with the cross-section lying in an X-Z plane extending through the coolant inlet port and the second fluid inlet port.
Figure 6:
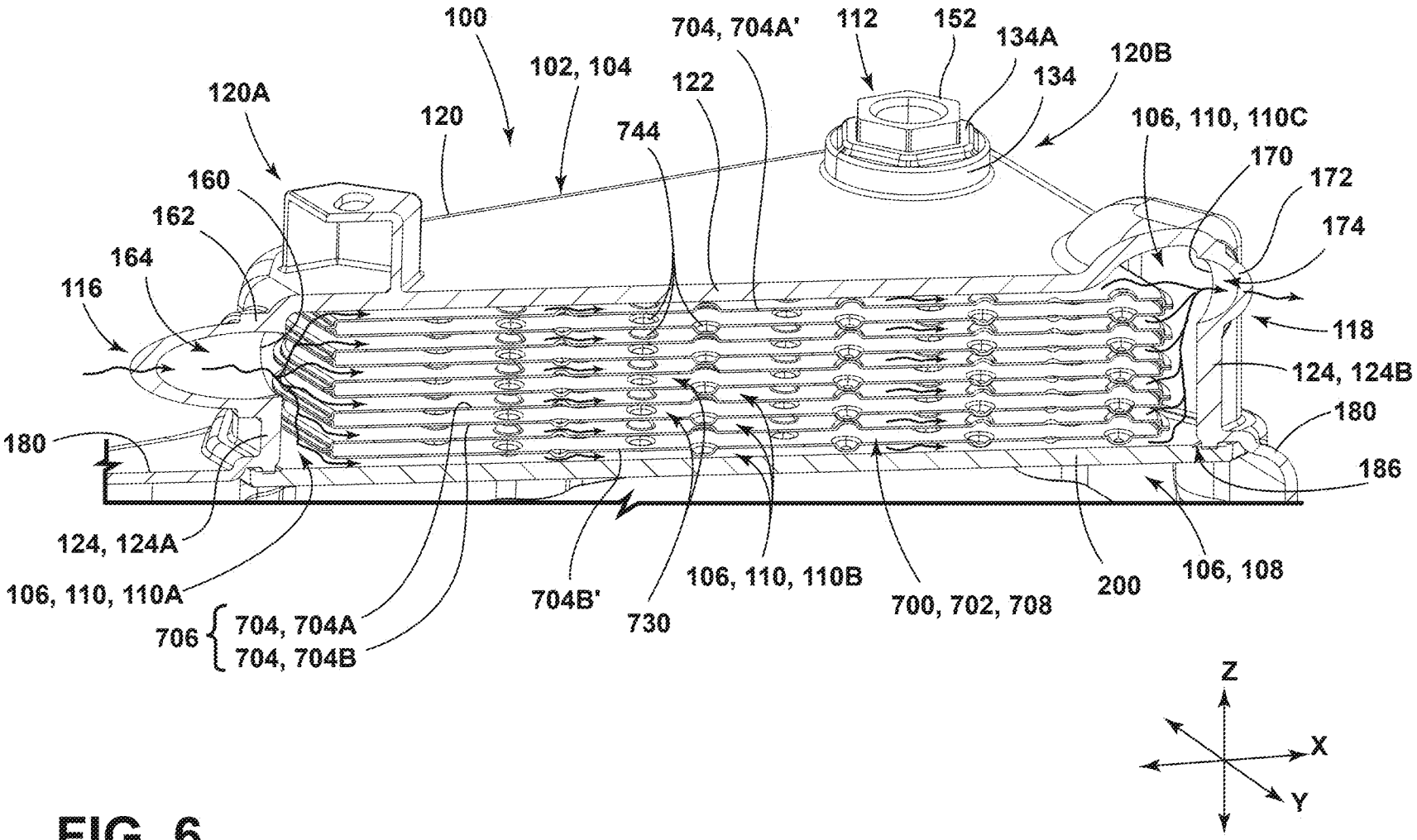
FIG. 6 is a cross-sectional perspective view of the module of FIG. 1 with the cross-section lying in a plane that is perpendicular to an X-Y plane and extends through the coolant ports.

As generally illustrated in FIGS. 3, 4, and 6, the housing 102, housing shell 104, and/or HE section 120 includes a plurality of coolant openings (e.g., a coolant inlet opening 160, a coolant outlet opening 170) via which the coolant is flowable into and/or out of the HE section 120 and/or the HE space 110. The coolant openings 160, 170 are disposed in and defined by one or more of the sidewalls 124 of the HE section 120 of the housing shell 104. In the illustrative examples depicted herein, the coolant inlet opening 160 is disposed in and defined by a first sidewall 1241 and the coolant outlet opening 170 is disposed in and defined by a different, second sidewall 1242. The coolant inlet opening 160 is disposed on the first side 120A of the HE section 120 and the coolant outlet opening 170 is disposed on the second side 120B of the HE section 120.

As generally illustrated in FIGS. 1, 3, 4, and 6, the housing 102, housing shell 104, and/or HE section 120 further includes a coolant inlet connector 162 via which the module 100 is connectable to one or more other components that supply and/or convey coolant to the module 100. The coolant inlet connector 162 is configured to engage and/or connect to the coolant supplying component. The coolant inlet connector 162 is a tube member and/or annular body disposed on the first side 120A of the HE section 120. The coolant inlet connector 162 projects from the HE section 120 and/or the first sidewall 124; in a direction away from the HE space 110, and extends around the perimeter of the coolant inlet opening 160. The coolant inlet connector 162 includes and/or defines an intake duct 164 that communicates coolant from the coolant supplying component connected to the coolant inlet connector 162 to the HE space 110. The coolant inlet connector 162 (e.g., the intake duct 164) is in fluid communication with the HE space 110 of the housing 102 (e.g., the coolant distribution region 110A) by way of the coolant inlet opening 160. The coolant inlet connector 162 and the coolant inlet opening 160 collectively define a coolant inlet port 116 of the module 100 via which the coolant is flowable into the module 100 and/or the HE section 120.

The housing 102, housing shell 104, and/or HE section 120 further includes a coolant outlet connector 172 via which the module 100 is connectable to one or more other components that receive coolant from the module 100. The coolant outlet connector 172 is configured to engage and/or connect to the coolant receiving component. The coolant outlet connector 172 is a tube member and/or annular body disposed on the second side 120B of the HE section 120. The coolant outlet connector 172 projects from the HE section 120 and/or the second sidewall 1242 in a direction away from the HE space 110, and extends around the perimeter of the coolant outlet opening 170. The coolant outlet connector 172 includes and/or defines an output duct 174 that communicates coolant from the HE space 110 to the coolant receiving component connected to the coolant outlet connector 172. The coolant outlet connector 172 (e.g., the output duct 174) is in fluid communication with the HE space 110 of the housing 102 (e.g., the coolant collection region 110A) by way of the coolant outlet opening 170. The coolant outlet connector 172 and the coolant outlet opening 170 collectively define a coolant outlet port 118 of the module 100 via which the coolant is flowable out from the module 100 and/or the HE section 120.

As generally illustrated in FIGS. 2 and 4-8C, the cover 200 is structured as and/or includes a generally planar body, which optionally extends substantially parallel to one or both of the base walls 122, 182. The cover 200 is disposed inside the housing shell 104 and partitions and/or divides the internal space 106 of the housing shell 104 into the sump space 108 and the HE space 110. The cover 200 separates and seals the HE space 110, the heat exchanger 700, and the coolant from the sump space 108, the sump 600, and the first fluid. The sump section 180 of the housing shell 104, the cover 200, and the structure 300 (e.g., the second housing shell 300' of the housing 102) collectively define and/or delimit the sump space 108. The HE section 120 of the housing shell 104 and the cover 200 collectively define and/or delimit the HE space 110. In other words, the cover 200 and the housing shell 104 each at least partially define and/or delimit the sump space 108 and the HE space 110.

The cover 200 is disposed on the housing shell 104 (e.g., on the base wall 182 of the sump section 180) and closes and/or covers the recess 186 of the sump section 180 and/or an end of the HE space 110. The cover 200 is sealingly connected, attached, and/or coupled to the housing shell 104 (e.g., the base wall 182 of the sump section 180) and thus fluidically seals the sump space 108 and the HE space 110 from one another. The cover 200 is disposed spaced apart from the HE core 702 such that a compensation gap is defined and/or formed between the cover 200 and the nearest plate (e.g., the lowermost plate 704B') of the HE core 702, which enables the module 100 to compensate for manufacturing tolerances and for thermal expansion of the HE core 702 and/or the plates 704 thereof during operation.

The cover 200 is non-releasably and/or non-removably connected to the housing shell 104 via an integral connection 202 (e.g., a weld and/or a welded connection) in the exemplary module 100 of FIGS. 1-7. In the exemplary module 100 depicted in FIGS. 8A-8C, the cover 200 is releasably connected to the housing shell 104 (e.g., the base wall 182 of the sump section 180) via one or more mechanical connections 212, such as via mechanical fasteners 214 (e.g., screws) engaging both the cover 200 and the housing shell 104, and a seal 216 (e.g., a ring seal) is disposed between and sealingly contacts the cover 200 and the housing shell 104 (e.g., the base wall 182 of the sump section 180) to facilitate sealing of the sump space 108 and the HE space 110. Connecting the cover 200 to the housing shell 104 with mechanical connections 212 enables the cover 200 to be removed from the housing shell 104 to gain access to the heat exchanger space 110 and the heat exchanger 700 (e.g., for maintenance and/or replacement purposes) and, thus, is advantageous with respect to repairability and overall service life of the module 100. The integral connection 202 of the cover 200 to the housing shell 104 is lighter and requires fewer components and/or elements than the mechanical connections 212 and is therefore advantageous with respect to the weight of the module 100 (see, e.g., para. [0039]) and material costs.

The housing shell 104 and/or the cover 200 are each composed of plastic, such as one or more polyamides for example. The housing shell 104 is composed of a first plastic material and the cover 200 is composed of a second plastic material. In some examples, such as those in which the cover 200 is laser welded (i.e., connected via a laser weld and/or a laser welded connection) to the housing shell 104 like the exemplary module 100 depicted in FIGS. 1-7, the first plastic material and the second plastic material are different from one another. The first plastic material of the housing shell 104 is, for example, a plastic material with laser absorbing properties (i.e., a laser-absorbing plastic), a first polyamide, and/or a laser-absorbing polyamide. Due to the laser absorbing properties of the first plastic material, a laser is able to heat and/or melt at least a portion or region of the housing shell 104, such as during a laser welding process. The second plastic material of the cover 200 is, for example, a plastic material with laser transparent properties (i.e., a laser-transparent plastic), a second polyamide that is different than the first polyamide, and/or a laser-transparent polyamide. The laser transparent properties of the second plastic material enable a laser, such as a laser utilized during a laser welding process, to pass through the cover 200 and reach the housing shell 104. As such, the laser absorbing properties of the first plastic material and the laser transparent properties of the second plastic material facilitate and/or enable the cover 200 and the housing shell 104 to be laser welded to one another (i.e., connected via a laser weld and/or a laser weld connection). In other examples, like the exemplary module 100 depicted in FIGS. 8A-8C in which the cover 200 is connected to the housing shell 104 via mechanical connections 212 and/or other exemplary modules in which the cover 200 is not laser welded to the housing shell 104, the first plastic material and the second plastic material may be the same such that the housing shell 104 and the cover 200 are composed of the same plastic material.

Optionally, the housing shell 104 and the portions thereof (e.g., the sump section 180, HE section 120, and/or portions thereof) are integrally formed as a monolithic body (e.g., via injection molding). In other words, the sections 120, 180, including the base walls 122, 182, the sidewalls 124, 184, and the other elements and/or features thereof (e.g., elements 132, 134, 134A, 142, 144, 144A, 162, 172), are integral portions of the housing shell 104. The cover 200 is also optionally formed as a monolithic body.

The heat exchanger 700 may be used to reject heat from the second fluid (e.g., oil, such as engine oil and/or transmission oil) to cool the second fluid and/or to transfer heat to the second fluid to warm/heat the second fluid. During operation, the second fluid and the coolant simultaneously flow through the module 100, the HE section 120, and/or the HE space 110 fluidically separated from one another. The second fluid received by the module 100 and/or the heat exchanger 700 (e.g., the HE core 702) can range from −40° C. to 160° C., while the coolant received by the module 100 and/or the HE space 110 can range from −40° C. to 130° C. The coolant absorbs heat from the second fluid as they flow through the module 100 and/or the HE section 120 thereby cooling the second fluid. Additionally and/or alternatively, the coolant absorbs heat (e.g., from an external environment and/or from one or more other components, assemblies, and/or structures) and the heated coolant transfers heat to the second fluid as they flow through the module 100 and/or the HE section 120 thereby warming and/or heating the second fluid. The coolant and the second fluid flow through the module 100 and/or the HE section 120 in different and/or generally opposing directions (e.g., the second fluid flows from the second side 120B to the first side 120A of the HE section 120 as shown in FIG. 5, while the coolant flows from the first side 120A to the second side 120B of the HE section 120 as shown in FIG. 6), which enhances and/or increases the cooling/heating efficiency of the heat exchanger 700.

As generally illustrated in FIGS. 3-6, the HE core 702 is arranged in the HE space 110 and completely surrounded and/or enclosed by the HE section 120 of the housing shell 104 and the cover 200. The HE core 702 is in fluid communication with the fluid ports 112, 114 and the second fluid flows internally through the HE core 702. The HE core 702 is not in fluid communication with the coolant ports 116, 118 and coolant does not flow internally through the HE core 702. Rather, the coolant ports 116, 118 are in direct fluid communication with the HE space 110 and coolant flowing through the HE space 110 flows externally around the HE core 702. The second fluid flowing internally through the HE core 702 is fluidically separated from the coolant flowing through the HE space 110 (e.g., via the HE core 702 and/or the plates 704).

The HE core 702 includes a plurality of plates 704 arranged in plate pairs 706 and disposed in a stacked arrangement to form and/or define a plate stack 708. Each plate pair 706 includes a first plate 704A and a second plate 704B that are connected to one another to define and/or delimit a fluid channel 730 therebetween. The plates 704 are composed of aluminum (i.e., are aluminum plates), but may conceivably be composed of other metals or materials. Adjacent plate pairs 706 are sealingly connected to one another around their openings 732, 734 (e.g., via brazing their annular opening collars together). Portions of the adjacent plate pairs 706 (e.g., the primary planar portion) are disposed spaced apart from one another such that a coolant channel 110B is defined between each pair of adjacent plate pairs 706 (e.g., by and between the first plate 704A of a first plate pair 706 and the second plate 704B of an adjacent second plate pair 706). A coolant channel 110B is also defined by and between the HE section 120 of the housing shell 104 (e.g., the base wall 122) and the plate 704 disposed closest thereto, which may also be referred to as the uppermost plate 704A'. Another coolant channel 110B, which defines and functions as the compensation gap, is defined by and between the cover 200 and the plate 704 disposed closest thereto, which may also be referred to as the lowermost plate 704B'. The coolant channels 110B extend between and fluidically connect a coolant distribution region 110A of the HE space 110 and a coolant collection region 110C of the HE space 110.

As generally illustrated in FIGS. 3 and 6, the coolant distribution region 110A is a region and/or portion of the HE space 110 disposed on the first side 102A of the housing 102. Coolant flows into the coolant distribution region 110A via the coolant inlet port 116, where it is distributed to the coolant channels 110B. At least a portion of the coolant distribution region 110A is disposed between the first sidewall 1241 of the HE section 120 and a first side of the HE core 702 and/or the plate stack 708 and extends along the first side of the HE core 702 and/or the plate stack 708 in a stacking direction of the plate stack 708 from the base wall 122 to the cover 200.

The coolant collection region 110C is a region and/or portion of the HE space 110 disposed on the second side 102B of the HE section 120. Coolant flows into the coolant collection region 110C from the coolant channels 110B, where it collects and flows to the coolant outlet port 118. The coolant collection region 110C is disposed at or about the coolant outlet opening 170 (e.g., the coolant outlet opening 170 opens into the coolant collection region 110C). At least a portion of the coolant collection region 110C is disposed between the second sidewall 1242 of the HE section 120 and an opposite, second side of the HE core 702 and/or the plate stack 708 and extends along at least a portion of the second side of the HE core 702 and/or plate stack 708 in the stacking direction from the base wall 122 to the cover 200.

As generally illustrated in FIG. 5, the HE core 702 further includes a plurality of first fluid openings 732 and a plurality of second fluid openings 734 that are disposed in and defined by the plates 704. The first fluid openings 732 are arranged on the second side 102B of the HE section 120 and collectively define and/or form a fluid inflow passage 736 that fluidically connects each of the fluid channels 730 to one another and to the fluid inlet port 112. The second fluid openings 734 are arranged on the first side 102A of the HE section 120 and collectively define and/or form a fluid outflow passage 738 that fluidically connects each of the fluid channels 730 to one another and to the fluid outlet port 114.

With the exception of the lowermost plate 704B', each of the plates 704 include a first fluid opening 732 and a second fluid opening 734. The lowermost plate 704B' does not include any fluid openings 732, 734, and closes an axial end of the fluid inflow passage 736 and the fluid outflow passage 738.

Figure 7:
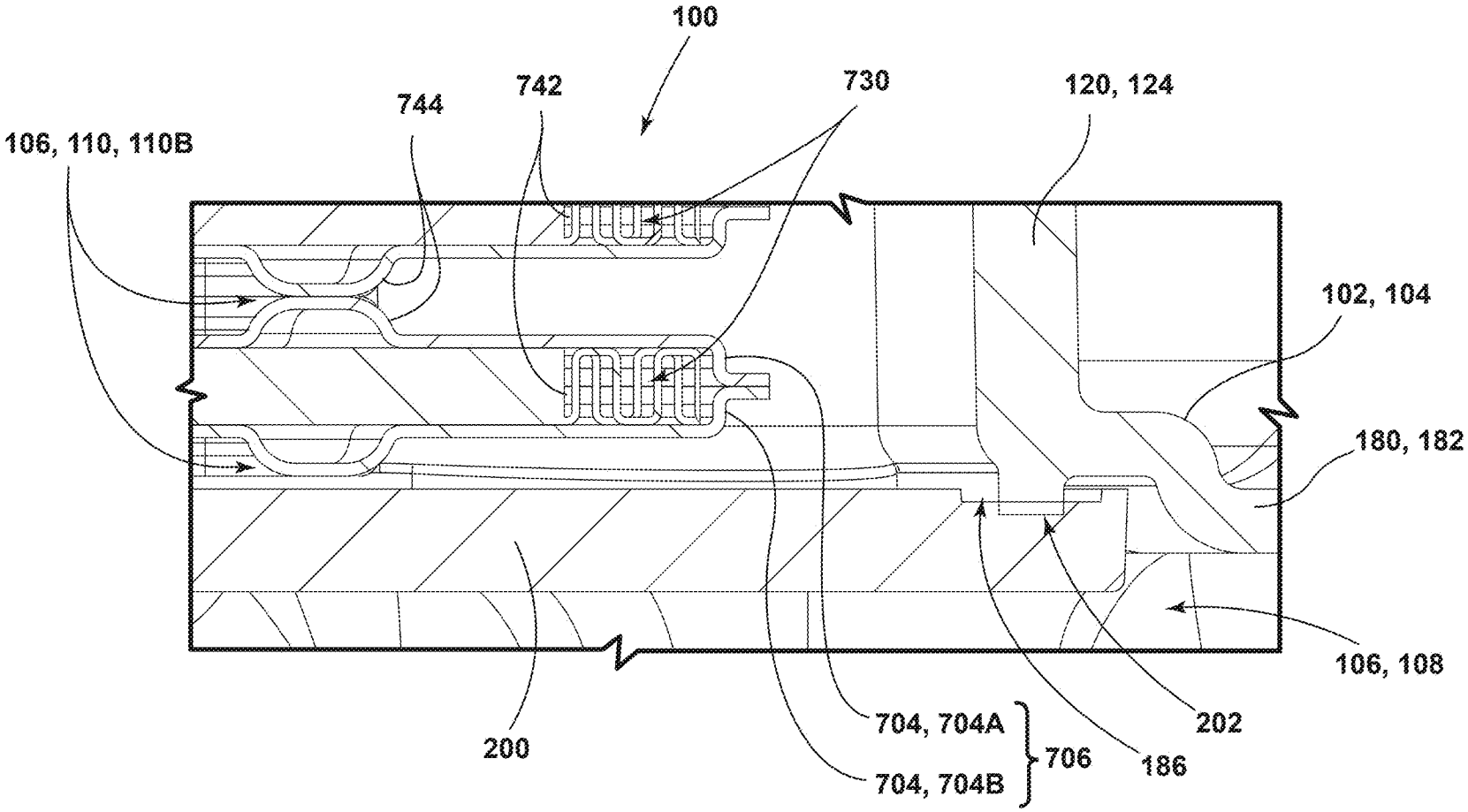
FIG. 7 depicts a close-up, cross-sectional view of the integral connection (e.g., weld and/or welded connection) between the housing shell and the cover of the module of FIG. 1.
Figure 8A:
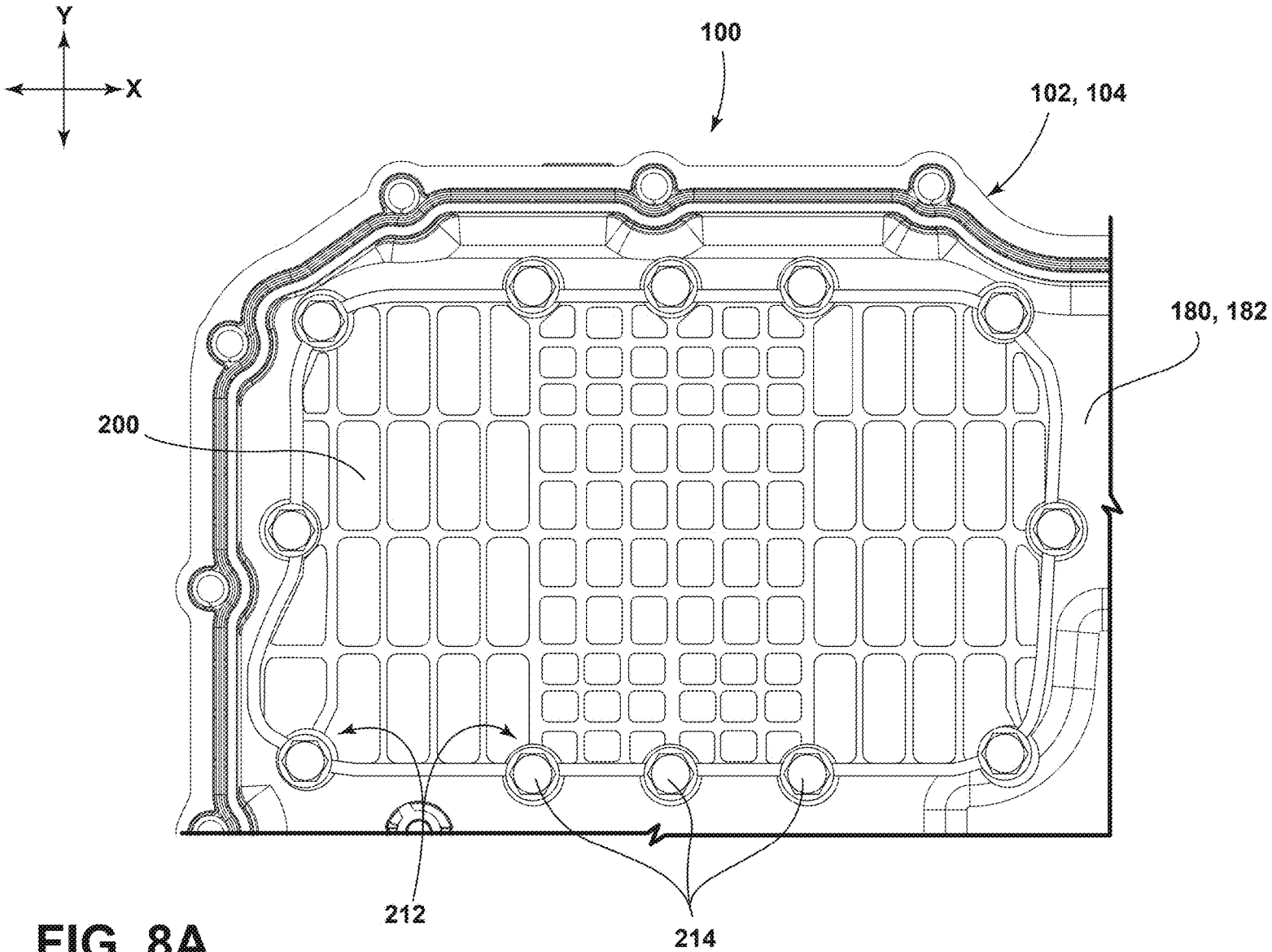
FIG. 8A is a partial, bottom-up view of another exemplary sump and heat exchanger module in which the housing shell and the cover are coupled via a mechanical connection.
Figure 8B:
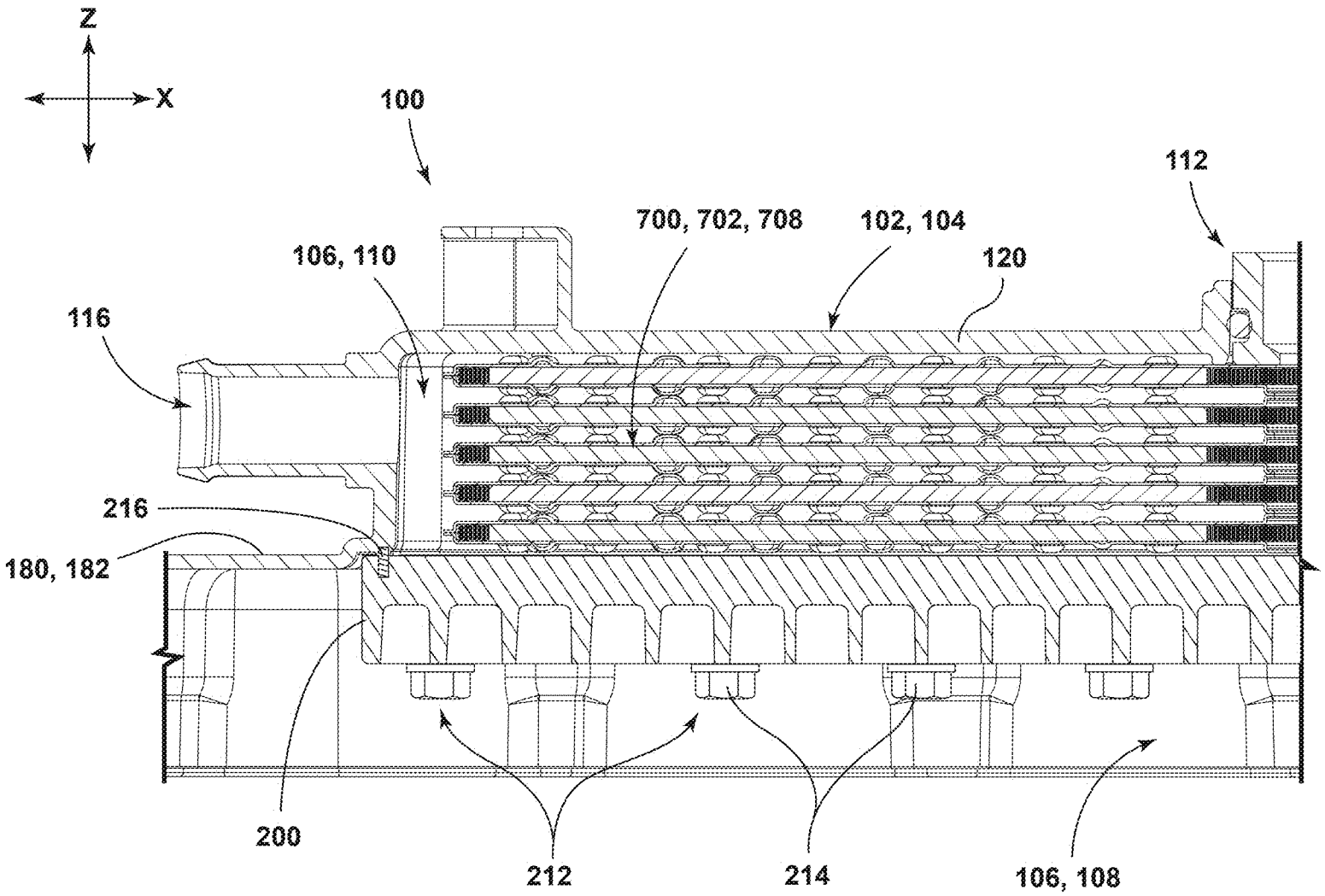
FIG. 8B is a cross-sectional view of the module of FIG. 8A with the cross-section lying in an X-Z plane extending through the coolant inlet port and the second fluid inlet port.
Figure 8C:
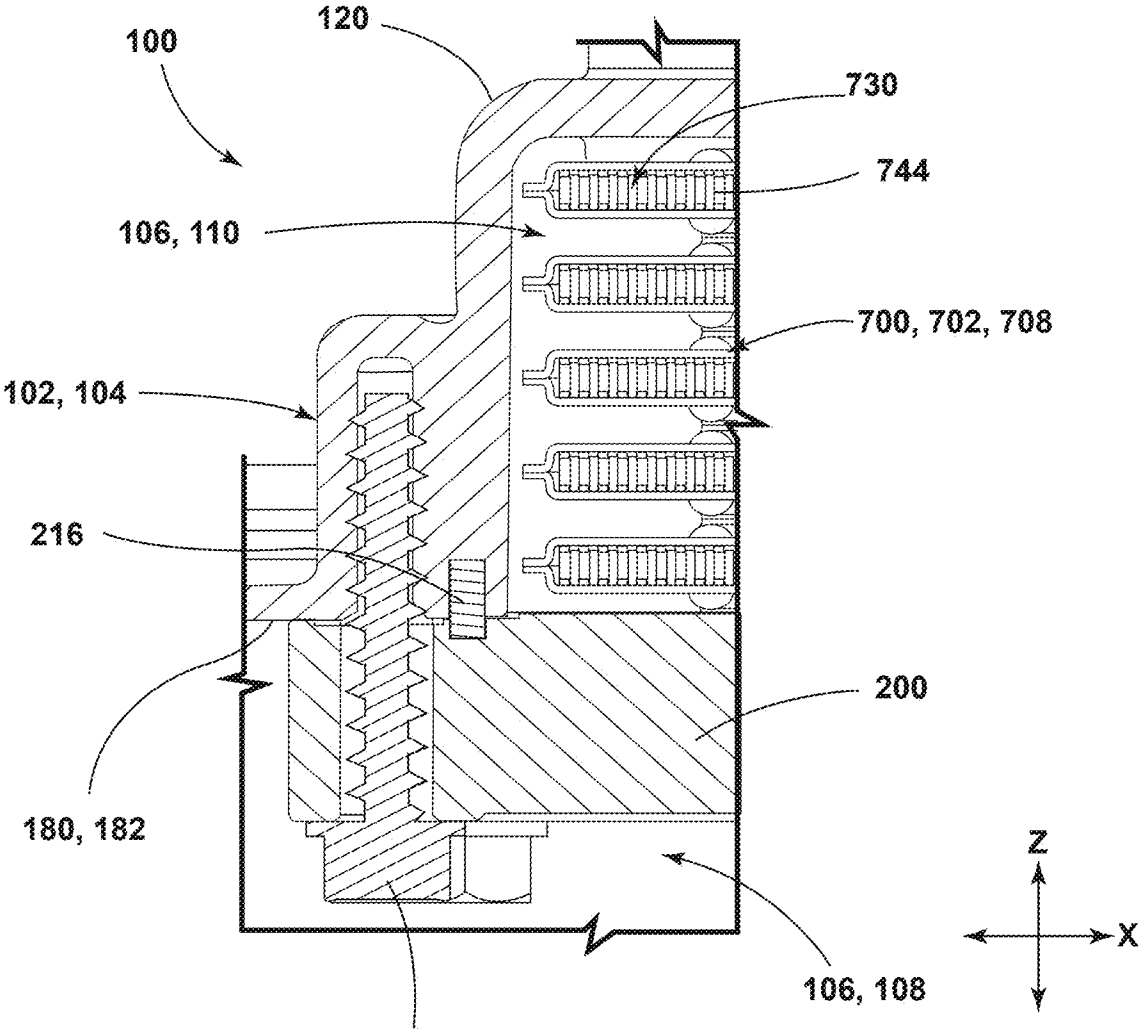
FIG. 8C is a close-up, cross-sectional view of the module of FIG. 8A with the cross-section lying in an X-Z plane extending through the housing shell, the cover, and a mechanical fastener.

As generally illustrated in FIGS. 7, 8B, and 8C, the HE core 702 includes a plurality of first turbulators 742 disposed in the fluid channels 730. The first turbulators 742 are structured as inserts that are each arranged between the first plate 704A and the second plate 704B of a respective plate pair 706. For simplicity, in FIGS. 7 and 8B, a portion of each of the first turbulators 742 is illustrated as a representative box rather than with the more detailed turbulation structure shown elsewhere. The first turbulators 742 are not illustrated in FIGS. 4-6 to provide an unobstructed view of the fluid channels 730. As generally illustrated in FIGS. 3-7, the HE core 702 also includes a plurality of second turbulators 744 that project into the coolant channels 110B. The second turbulators 744 are structured as a plurality of nubs (e.g., dome-shaped protrusions) that project from the plates 704 into the coolant channels 110B. The first and second turbulators 742, 744 enhance and/or improve cooling efficiency of the heat exchanger 700 and/or HE core 702 via causing turbulence in the second fluid and/or the coolant flowing through the channels 110B, 730 (e.g., to establish a more uniform heat distribution throughout the second fluid and/or coolant). The turbulators 742, 744 also restrict and/or limit deformation (e.g., thermal expansion) of the plates 704 during operation to prevent one or more of the channels 110B, 730 from becoming blocked and/or collapsed.

During operation, second fluid (e.g., oil) and coolant simultaneously flow through the module 100 and/or the HE section 120 of the housing shell 104. Optionally, the first fluid flows through the module 100, the sump section 180, the sump space 108, and/or the sump 600 simultaneously with the second fluid and the coolant flowing through the module 100 and/or the HE section 120.

As generally illustrated in FIG. 5, second fluid (e.g., oil) flows into the module 100, the housing 102, and/or the HE section 120 through the fluid inlet port 112 (e.g., the fluid inlet adapter 152 and the fluid inlet opening 130), where it then flows into the fluid inflow passage 736 of the HE core 702. The fluid within the fluid inflow passage 736 is distributed amongst the fluid channels 730 and flows through the fluid channels 730, including around the first turbulators 742, to the fluid outflow passage 738. The fluid from the fluid channels 730 collects in the fluid outflow passage 738 of the HE core 702, where it then flows out of the HE core 702 and is expelled from the HE section 120, the housing 102, and/or the module 100 via the fluid outlet port 114 (e.g., via the fluid outlet opening 140 and the fluid outlet adapter 154).

As generally illustrated in FIG. 6, coolant flows into the module 100, the housing 102, and/or the HE section 120 through the coolant inlet port 116 (e.g., the intake duct 164 and the coolant inlet opening 160), where it then flows into the coolant distribution region 110A of the HE space 110. The coolant within the coolant distribution region 110A is distributed amongst the coolant channels 110B and flows through the coolant channels 110B, including around the second turbulators 744, to the coolant collection region 110C of the HE space 110. The coolant from the coolant channels 110B collects in the coolant collection region 110C, where it then flows out of the HE space 110 and is expelled and/or output from the HE section 120, the housing 102, and/or the module 100 via the coolant outlet port 118 (e.g., via flowing through the coolant outlet opening 170 and the output duct 174).

Various examples/embodiments are described herein for various apparatuses, systems, and/or methods. Numerous specific details are set forth to provide a thorough understanding of the overall structure, function, manufacture, and use of the examples/embodiments as described in the specification and illustrated in the accompanying drawings. It will be understood by those skilled in the art, however, that the examples/embodiments may be practiced without such specific details. In other instances, well-known operations, components, and elements have not been described in detail so as not to obscure the examples/embodiments described in the specification. Those of ordinary skill in the art will understand that the examples/embodiments described and illustrated herein are non-limiting examples, and thus it can be appreciated that the specific structural and functional details disclosed herein may be representative and do not necessarily limit the scope of the embodiments.

Reference throughout the specification to "examples, "in examples," "with examples," "various embodiments," "with embodiments," "in embodiments," or "an embodiment," or the like, means that a particular feature, structure, or characteristic described in connection with the example/embodiment is included in at least one embodiment. Thus, appearances of the phrases "examples, "in examples," "with examples," "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more examples/embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of examples/embodiments.

"One or more" includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first element could be termed a second element, and, similarly, a second element could be termed a first element, without departing from the scope of the various described embodiments. The first element and the second element are both elements, but they are not the same element.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the phrase "at least one of" followed by successive elements separate by the word "and" (e.g., "at least one of A and B") is to be interpreted the same as "and/or" and as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Joinder references (e.g., attached, coupled, connected, and the like) are to be construed broadly and may include intermediate members between a connection of elements, relative movement between elements, direct connections, indirect connections, fixed connections, movable connections, operative connections, indirect contact, and/or direct contact. As such, joinder references do not necessarily imply that two elements are directly connected/coupled and in fixed relation to each other. Connections of electrical components, if any, may include mechanical connections, electrical connections, wired connections, and/or wireless connections, among others. Uses of "e.g." and "such as" in the specification are to be construed broadly and are used to provide non-limiting examples of embodiments of the disclosure, and the disclosure is not limited to such examples.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

All matter contained in the above description or shown in the accompanying drawings shall be interpreted as illustrative only and not limiting. Changes in detail or structure may be made without departing from the present disclosure.

It should be understood that a controller, a system, and/or a processor as described herein may include a conventional processing apparatus known in the art, which may be capable of executing preprogrammed instructions stored in an associated memory, all performing in accordance with the functionality described herein. To the extent that the methods described herein are embodied in software, the resulting software can be stored in an associated memory and can also constitute means for performing such methods. Such a system or processor may further be of the type having ROM, RAM, RAM and ROM, and/or a combination of non-volatile and volatile memory so that any software may be stored and yet allow storage and processing of dynamically produced data and/or signals.

It should be further understood that an article of manufacture in accordance with this disclosure may include a non-transitory computer-readable storage medium having a computer program encoded thereon for implementing logic and other functionality described herein. The computer program may include code to perform one or more of the methods disclosed herein. Such embodiments may be configured to execute via one or more processors, such as multiple processors that are integrated into a single system or are distributed over and connected together through a communications network, and the communications network may be wired and/or wireless. Code for implementing one or more of the features described in connection with one or more embodiments may, when executed by a processor, cause a plurality of transistors to change from a first state to a second state. A specific pattern of change (e.g., which transistors change state and which transistors do not), may be dictated, at least partially, by the logic and/or code.

The specification can be best understood with reference to the following Numbered Paragraphs:

Numbered Paragraph 1: A sump and heat exchanger module, comprising: a housing shell at least partially defining an internal space, the housing shell including a sump section configured to receive at least a portion of a sump and a heat exchanger section configured to receive at least a portion of a heat exchanger; and a cover disposed in the housing shell and dividing the internal space into a heat exchanger space and a sump space; the housing shell further including a recess via which the heat exchanger space opens into the sump space; and wherein the cover is connected to the housing shell and closes the recess sealing the heat exchanger space and the sump space from one another.

Numbered Paragraph 2: The module of Numbered Paragraph 1, further comprising: a sump disposed at least partially in the sump space of the housing shell; and a heat exchanger disposed at least partially in the heat exchanger space of the housing shell.

Numbered Paragraph 2.1: The module of Numbered Paragraph 1, further comprising a sump disposed at least partially in the sump space of the housing shell.

Numbered Paragraph 2.2: The module of Numbered Paragraph 1, further comprising a heat exchanger disposed at least partially in the heat exchanger space of the housing shell.

Numbered Paragraph 3: The module of any one of the preceding Numbered Paragraphs, wherein the heat exchanger section of the housing shell and the cover define the heat exchanger space; and the sump section of the housing shell and the cover at least partially define the sump space.

Numbered Paragraph 3.1: The module according to any one of the preceding Numbered Paragraphs, wherein the heat exchanger section of the housing shell and the cover define the heat exchanger space.

Numbered Paragraph 3.2: The module according to any one of the preceding Numbered Paragraphs, wherein the sump section of the housing shell and the cover at least partially define the sump space.

Numbered Paragraph 4: The module of any one of the preceding Numbered Paragraphs, further comprising a second housing shell connected to the sump section of the housing shell, wherein the sump section of the housing shell, the cover, and the second housing shell define the sump space.

Numbered Paragraph 5: The module of any one of the preceding Numbered Paragraphs, wherein the heat exchanger section is disposed on and projects from the sump section.

Numbered Paragraph 6: The module of any one of the preceding Numbered Paragraphs, wherein: the sump section includes a base wall and a plurality of sidewalls, the plurality of sidewalls projecting transversely from the base wall and extending around an outer perimeter of the base wall; and the recess is disposed in and defined by the base wall of the sump section.

Numbered Paragraph 6.1: The module of any one of the preceding Numbered Paragraphs, wherein the sump section includes a base wall and a plurality of sidewalls, the plurality of sidewalls projecting transversely from the base wall and extending around an outer perimeter of the base wall.

Numbered Paragraph 6.2: The module of any one of the preceding Numbered Paragraphs, wherein the recess is disposed in and defined by a base wall of the sump section.

Numbered Paragraph 7: The module of any one of Numbered Paragraphs 6, 6.1, and 6.2, wherein the heat exchanger section is disposed on and projects from the base wall of the sump section.

Numbered Paragraph 8: The module of any one of Numbered Paragraphs 6, 6.1, and 6.2, wherein the heat exchanger section includes: a base wall disposed opposite the recess; and a plurality of sidewalls extending between and connecting the base wall of the heat exchanger section and the base wall of the sump section.

Numbered Paragraph 9: The module of Numbered Paragraph 8, wherein the plurality of sidewalls of the heat exchanger section project transversely from the base wall of the heat exchanger section, extend around an outer perimeter of the base wall of the heat exchanger section, and extend around an outer perimeter of the recess.

Numbered Paragraph 10: The module of any one of the preceding Numbered Paragraphs, wherein the heat exchanger section of the housing shell includes: a plurality of coolant ports via which a coolant is flowable into and out of the heat exchanger section; and a plurality of fluid ports via which a fluid is flowable into and out of the heat exchanger section.

Numbered Paragraph 10.1: The module of any one of the preceding Numbered Paragraphs, wherein the heat exchanger section of the housing shell includes a plurality of coolant ports via which a coolant is flowable into and out of the heat exchanger section.

Numbered Paragraph 10.2: The module of any one of the preceding Numbered Paragraphs, wherein the heat exchanger section of the housing shell includes a plurality of fluid ports via which a fluid is flowable into and out of the heat exchanger section.

Numbered Paragraph 11: The module of any one of the preceding Numbered Paragraphs, wherein the heat exchanger section of the housing shell further includes a plurality of coolant connectors configured to engage at least one component that at least one of supplies the coolant to and receives the coolant from the module.

Numbered Paragraph 12: The module of Numbered Paragraph 11, wherein the plurality of coolant connectors are integral portions of the heat exchanger section of the housing shell.

Numbered Paragraph 13: The module of any one of Numbered Paragraphs 10, 10.1, and 10.2, further comprising a heat exchanger disposed at least partially in the heat exchanger space of the housing shell, wherein: the heat exchanger includes a heat exchanger core with a plurality of plates disposed in a stacked arrangement to define a plate stack; the plurality of coolant ports are in direct fluid communication with the heat exchanger space such that the coolant flows through the heat exchanger space and externally around the heat exchanger core; and the plurality of fluid ports are in fluid communication with the heat exchanger such that the fluid flows internally through the heat exchanger core and is fluidically separated from the coolant flowing through the heat exchanger space.

Numbered Paragraph 13.1: The module of any one of Numbered Paragraphs 10, 10.1, and 10.2, further comprising a heat exchanger disposed at least partially in the heat exchanger space of the housing shell, wherein the heat exchanger includes a heat exchanger core with a plurality of plates disposed in a stacked arrangement to define a plate stack.

Numbered Paragraph 13.2: The module of Numbered Paragraph 13.1, wherein the plurality of coolant ports are in direct fluid communication with the heat exchanger space such that the coolant flows through the heat exchanger space and externally around the heat exchanger core.

Numbered Paragraph 13.3: The module of Numbered Paragraph 13.1 or 13.2, wherein the plurality of fluid ports are in fluid communication with the heat exchanger such that the fluid flows internally through the heat exchanger core and is fluidically separated from the coolant.

Numbered Paragraph 14: The module of any one of the preceding Numbered Paragraphs, wherein: the heat exchanger section and the sump section are integral portions of the housing shell; and the housing shell is a monolithic body composed of a corrosion resistant plastic.

Numbered Paragraph 14.1: The module of any one of the preceding Numbered Paragraphs, wherein the heat exchanger section and the sump section are integral portions of the housing shell.

Numbered Paragraph 14.2: The module of any one of the preceding Numbered Paragraphs, wherein the housing shell is a monolithic body composed of a corrosion resistant plastic.

Numbered Paragraph 15: The module of any one of the preceding Numbered Paragraphs, wherein the cover is welded to the housing shell.

Numbered Paragraph 16: The module of any one of the preceding Numbered Paragraphs, wherein the cover is releasably connected to the housing shell via at least one mechanical connection.

Numbered Paragraph 17: The module of Numbered Paragraph 16, further comprising: at least one mechanical fastener engaging the cover and the housing shell to form the at least one mechanical connection; and a ring seal disposed between and sealingly contacting the cover and the housing shell.

Numbered Paragraph 17.1: The module of Numbered Paragraph 16, further comprising at least one mechanical fastener engaging the cover and the housing shell to form the at least one mechanical connection.

Numbered Paragraph 17.2: The module of any one of the preceding Numbered Paragraphs, further comprising a ring seal disposed between and sealingly contacting the cover and the housing shell.

Numbered Paragraph 18: A sump and heat exchanger module, comprising: a housing shell including (i) a sump section at least partially defining a sump space and (ii) a heat exchanger section at least partially defining a heat exchanger space; a cover disposed in and connected to the housing shell fluidically sealing the heat exchanger space and the sump space from one another; a sump disposed at least partially in the sump space of the housing shell; and a heat exchanger disposed at least partially in the heat exchanger space of the housing shell.

Numbered Paragraph 19: The module of any one of Numbered Paragraphs 2, 13, 13.1, 13.2, 13.3, and 18, wherein the heat exchanger is a submarine-style heat exchanger.

Numbered Paragraph 20: The module of Numbered Paragraph 18, wherein: the heat exchanger section is disposed on and projects from the sump section; an end of the sump section opposite the heat exchanger section is configured to connect to a structure for at least one of closing the sump space and mounting the module; the cover closes a recess of the housing shell via which the heat exchanger space opens into the sump space; and the heat exchanger section and the sump section are integral portions of the housing shell.

Numbered Paragraph 20.1: The module of any one of the preceding Numbered Paragraphs, wherein the heat exchanger section is disposed on and projects from the sump section.

Numbered Paragraph 20.2: The module of any one of the preceding Numbered Paragraphs, wherein an end of the sump section opposite the heat exchanger section is configured to connect to a structure for at least one of closing the sump space and mounting the module.

Numbered Paragraph 20.3: The module of any one of Numbered Paragraphs 18-20.2, wherein the cover closes a recess of the housing shell via which the heat exchanger space opens into the sump space.

Numbered Paragraph 20.4: The module of any one of the preceding Numbered Paragraphs, wherein the heat exchanger section and the sump section are integral portions of the housing shell.

What is claimed is:

1. A sump and heat exchanger module, comprising:

a housing shell at least partially defining an internal space, the housing shell including a sump section configured to receive at least a portion of a sump and a heat exchanger section configured to receive at least a portion of a heat exchanger; and a cover disposed in the housing shell and dividing the internal space into a heat exchanger space and a sump space;

the housing shell further including a recess via which the heat exchanger space opens into the sump space; and wherein the cover is connected to the housing shell and closes the recess sealing the heat exchanger space and the sump space from one another.

2. The module of claim 1, further comprising:

a sump disposed at least partially in the sump space of the housing shell; and a heat exchanger disposed at least partially in the heat exchanger space of the housing shell.

3. The module of claim 1, wherein:

the heat exchanger section of the housing shell and the cover define the heat exchanger space; and the sump section of the housing shell and the cover at least partially define the sump space.

4. The module of claim 3, further comprising a second housing shell connected to the sump section of the housing shell, wherein the sump section of the housing shell, the cover, and the second housing shell define the sump space.

5. The module of claim 1, wherein the heat exchanger section is disposed on and projects from the sump section.

6. The module of claim 1, wherein:

the sump section includes a base wall and a plurality of sidewalls, the plurality of sidewalls projecting transversely from the base wall and extending around an outer perimeter of the base wall; and the recess is disposed in and defined by the base wall of the sump section.

7. The module of claim 6, wherein the heat exchanger section is disposed on and projects from the base wall of the sump section.

8. The module of claim 6, wherein the heat exchanger section includes:

a base wall disposed opposite the recess; and a plurality of sidewalls extending between and connecting the base wall of the heat exchanger section and the base wall of the sump section.

9. The module of claim 8, wherein the plurality of sidewalls of the heat exchanger section project transversely from the base wall of the heat exchanger section, extend around an outer perimeter of the base wall of the heat exchanger section, and extend around an outer perimeter of the recess.

10. The module of claim 1, wherein the heat exchanger section of the housing shell includes:

a plurality of coolant ports via which a coolant is flowable into and out of the heat exchanger section; and a plurality of fluid ports via which a fluid is flowable into and out of the heat exchanger section.

11. The module of claim 10, wherein the heat exchanger section of the housing shell further includes a plurality of coolant connectors configured to engage at least one component that at least one of supplies the coolant to and receives the coolant from the module.

12. The module of claim 11, wherein the plurality of coolant connectors are integral portions of the heat exchanger section of the housing shell.

13. The module of claim 10, further comprising a heat exchanger disposed at least partially in the heat exchanger space of the housing shell, wherein:

the heat exchanger includes a heat exchanger core with a plurality of plates disposed in a stacked arrangement to define a plate stack;

the plurality of coolant ports are in direct fluid communication with the heat exchanger space such that the coolant flows through the heat exchanger space and externally around the heat exchanger core; and the plurality of fluid ports are in fluid communication with the heat exchanger such that the fluid flows internally through the heat exchanger core and is fluidically separated from the coolant flowing through the heat exchanger space.

14. The module of claim 1, wherein:

the heat exchanger section and the sump section are integral portions of the housing shell; and the housing shell is a monolithic body composed of a corrosion resistant plastic.

15. The module of claim 1, wherein the cover is welded to the housing shell.

16. The module of claim 1, wherein the cover is releasably connected to the housing shell via at least one mechanical connection.

17. The module of claim 16, further comprising:

at least one mechanical fastener engaging the cover and the housing shell to form the at least one mechanical connection; and a ring seal disposed between and sealingly contacting the cover and the housing shell.

18. A sump and heat exchanger module, comprising:

a housing shell including (i) a sump section at least partially defining a sump space and (ii) a heat exchanger section at least partially defining a heat exchanger space;

a cover disposed in and connected to the housing shell fluidically sealing the heat exchanger space and the sump space from one another;

a sump disposed at least partially in the sump space of the housing shell; and a heat exchanger disposed at least partially in the heat exchanger space of the housing shell.

19. The module of claim 18, wherein the heat exchanger is a submarine-style heat exchanger.

20. The module of claim 18, wherein:

the heat exchanger section is disposed on and projects from the sump section;

an end of the sump section opposite the heat exchanger section is configured to connect to a structure for at least one of closing the sump space and mounting the module;

the cover closes a recess of the housing shell via which the heat exchanger space opens into the sump space; and the heat exchanger section and the sump section are integral portions of the housing shell.

* * * * *